US007959468B2

(12) United States Patent
Yong et al.

(10) Patent No.: US 7,959,468 B2
(45) Date of Patent: Jun. 14, 2011

(54) SHIELDING CONNECTOR

(75) Inventors: Zhu Yong, Yokkaichi (JP); Satoshi Tsuruta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/643,082

(22) Filed: Dec. 21, 2009

(65) Prior Publication Data

US 2010/0178805 A1 Jul. 15, 2010

(30) Foreign Application Priority Data

Jan. 14, 2009 (JP) ..... 2009-005658

(51) Int. Cl.
*H01R 9/03* (2006.01)

(52) U.S. Cl. ..... 439/607.41

(58) Field of Classification Search ..... 439/670.41, 439/607.44, 607.43, 610, 608, 859, 877, 439/752, 680, 353; 174/94 R, 35 R, 35 C, 174/65 G, 74 R See application file for complete search history.

(56) References Cited

U.S. PATENT DOCUMENTS 3,757,274 A * 9/1973 Hazelhurst ..... 439/281
4,911,660 A * 3/1990 Alf et al. ..... 439/585
5,180,316 A * 1/1993 Miller et al. ..... 439/607.5
5,232,380 A * 8/1993 Inoue et al. ..... 439/607.5
5,931,699 A * 8/1999 Saito ..... 439/587
5,961,351 A * 10/1999 Wu ..... 439/607.45
6,142,828 A * 11/2000 Pepe ..... 439/607.43
6,464,538 B2 * 10/2002 Miyazaki et al. ..... 439/607.44
6,583,352 B2 * 6/2003 Fukushima et al. ..... 174/373
6,716,071 B2 * 4/2004 Miyazaki ..... 439/859
6,830,480 B2 * 12/2004 Yoshioka ..... 439/607.42
7,070,449 B2 * 7/2006 Miyazaki ..... 439/587
7,530,843 B1 * 5/2009 Tesfay et al. ..... 439/587
7,530,848 B2 * 5/2009 Nagashima et al. ..... 439/607.41
7,540,775 B2 * 6/2009 Eckel et al. ..... 439/587
7,614,910 B2 * 11/2009 Croteau et al. ..... 439/573
7,666,032 B2 * 2/2010 Aoki et al. ..... 439/607.41
7,749,025 B2 * 7/2010 Aoki et al. ..... 439/607.41
2001/0029120 A1 * 10/2001 Miyazaki et al. ..... 439/98
2004/0266261 A1 * 12/2004 Miyazaki ..... 439/587

FOREIGN PATENT DOCUMENTS

JP 2002-008746 1/2002

* cited by examiner

*Primary Examiner* — T C Patel
*Assistant Examiner* — Harshad C Patel
(74) *Attorney, Agent, or Firm* — Gerald E. Hespos; Michael J. Porco

(57) ABSTRACT

A shielding connector has shielding electric wires (10) and a terminal fitting (20) mounted on an end of each of the shielding electric wires (10). The connector also has a housing (30) made of synthetic resin and configured to fit in a mounting hole (62) in a case (60). Terminal insertion chambers (32) are provided inside the housing (30) and receive the terminal fittings (20). A rubber stopper (37) is fitted on an entrance (36) of each of the terminal insertion chambers (32). A metal shielding shell (50) is mounted to cover a rear surface of the housing (30) and has a mounting plate (57) to be fixed to the case (60). Connection tubes (53) project on a rear surface of the shielding shell (50) and communicate with the terminal insertion chambers (32). Braided wires (13) of the shielding electric wires (10) can be connected the connection tubes (53).

7 Claims, 6 Drawing Sheets

SHIELDING CONNECTOR

BACKGROUND OF THE INVENTION

1. Field of the Invention

The invention relates to a shielding connector.

2. Description of the Related Art

Japanese Patent Unexamined Publication No. 2002-8746 discloses a shielding connector that is used with a plurality of shielding electric wires each of which has a core and a braided wire shielding layer. The shielding connector has terminal fittings connected respectively to the ends of the cores of each of the shielding electric wires. The shielding connector also has a conductive flange fixed to the end of each exposed braided wire. The fixed portion of the conductive flange is resin-molded partly in the housing of the shielding connector so that a peripheral portion of the conductive flange projects from the housing.

The housing of the shielding connector is fit in a mounting hole formed on a metal case of an appliance and the peripheral portion of the conductive flange projected from the housing is fixed to a surface of the case of the appliance by a bolt. Thus, each braided wire is connected electrically to the case of the appliance.

An adhesive agent is used with the shielding conductor to waterproof the shielding electric wires and the projected portion of the conductive flange. Thus, the shielding connector of JP 2002-8746 is produced by a complex process with many steps.

The shielding connector of JP 2002-8746 also requires a complicated connection of the braided of each shielding electric wire to the case for the appliance. Therefore there is room for improvement in the shielding connector of the JP 2002-8746.

The invention has been completed in view of the above-described situation. It is an object of the invention to provide a shielding connector which has a simple construction and allows a work to be performed in a simple process while achieving reliable shielding waterproof function and a shielding function.

SUMMARY OF THE INVENTION

The invention relates to a shielding connector for a plurality of shielding electric wires. Each of the shielding electric wires has an end and a terminal fitting mounted on the end. Each of the shielding electric wires also has a braided wire shielding layer. The shielding connector has a housing made of synthetic resin and configured for fitting in a mounting hole that penetrates through a metal case for an appliance. Terminal insertion chambers are provided inside the housing and are configured to receive the terminal fittings. A rubber stopper is fit on an entrance of each of the terminal insertion chambers. A metal shielding shell is mounted on the housing and has a mounting portion to be fixed to the case. The shielding shell covers a rear surface of the housing. Connection tubes project on a rear surface of the shielding shell and communicate respectively with the terminal insertion chambers respectively. Ends of the braided wires are connected respectively to the connection tubes.

The terminal fittings at the end of the shielding electric wires are inserted into the respective terminal insertion chambers of the housing. The rubber stopper is fit on the entrance of each of the terminal insertion chambers to waterproof the inside of the housing. The shielding shell is fixed to the housing with and covers the rear surface of the housing. The end of the braided wire of each of the shielding electric wires is connected to the connection tube that projects on the rear surface of the shielding shell. In this state, the housing is fit in the mounting hole of the case for the appliance and the mounting portion of the shielding shell is fixed to the case. In this manner, the braided wire of each shielding electric wire is electrically connected to the case.

The inside of the housing is waterproofed with the rubber stopper. Thus, the housing can be sealed with a high reliability. The braided wire of each shielding electric wire is connected to the connection tube that projects at the outer-surface of the shielding shell. This connection operation can be accomplished simply and reliably.

The shielding shell preferably is configured so that the connection tube projects from a rear surface of a concavity in which a rear end portion of the housing is fit and the shielding shell may be formed by performing two-stage deep-drawing of a metal plate. Thus the shielding shell can be produced comparatively simply.

The end of the braided wire preferably is exposed to the outside by peeling the insulation outer coating of the shielding electric wire and then is fit on the periphery of the connection tube. A caulking ring preferably is provided on the periphery of the end of the braided wire and is caulked to secure the braided wire to the connection tube.

A protection member made of synthetic resin preferably is fit in the connection tube and has a central hole for receiving an inner insulation coating of the shielding electric wire. Therefore, the protection member prevents the inner insulation coating from directly contacting the inner peripheral surface of the metal connection tube when he shielded electric wire is shaken, thereby preventing damage to the inner insulation coating.

The shielding connector has a simple construction, allows a work to be performed in a simple process and reliably performs waterproofing and shielding functions.

DETAILED DESCRIPTION OF THE PREFERRED EMBODIMENT

A shielding connector in accordance with the invention is identified by the letter C in FIGS. 1 to 6. The connector C can mounted at an inverter of an electric car to electrically connect the inverter to a motor of an electric appliance, such as an air conditioner mounted on a vehicle. The inverter is accommodated inside a metal case 60 having a shielding function.

The connector C is connected to first ends of two shielding electric wires 10. The second ends of the two shielding electric wires 10 are connected to a mating appliance. More specifically, terminal fittings 20 are connected to first ends of the shielding electric wires 10 and are accommodated inside a synthetic resin housing 30 mounted on the case 60 of the inverter.

Figure 6:
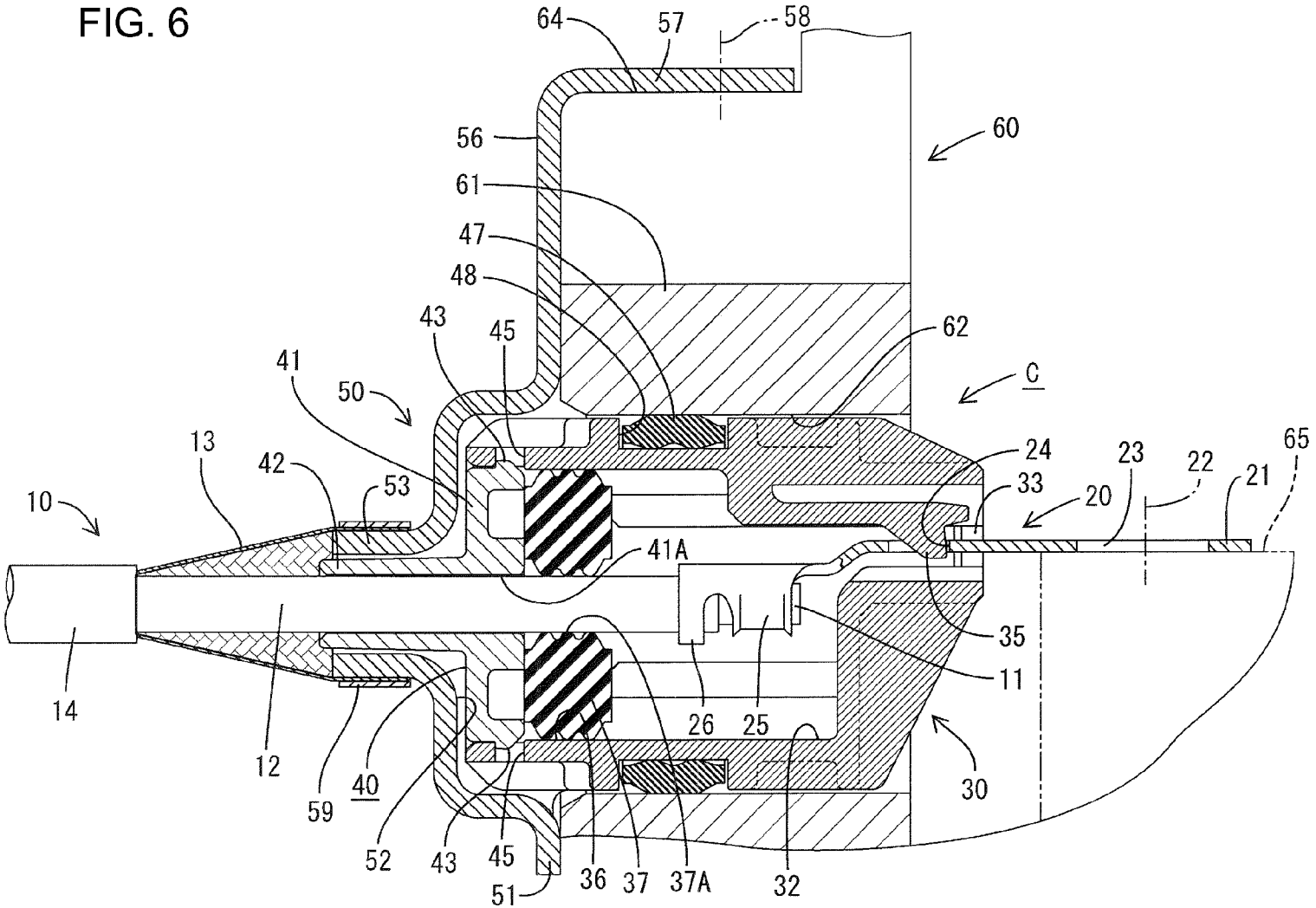
FIG. 6 is a sectional view taken along a line VI-VI of FIG. 2 in a state in which the connector has been mounted on a case.

As shown in FIG. 6, the shielding electric wire 10 has a core wire 11, an inner insulation coating 12, a braided wire 13 and an outer insulation coating 14 concentrically and sequentially arranged from the axis thereof.

Figure 5:
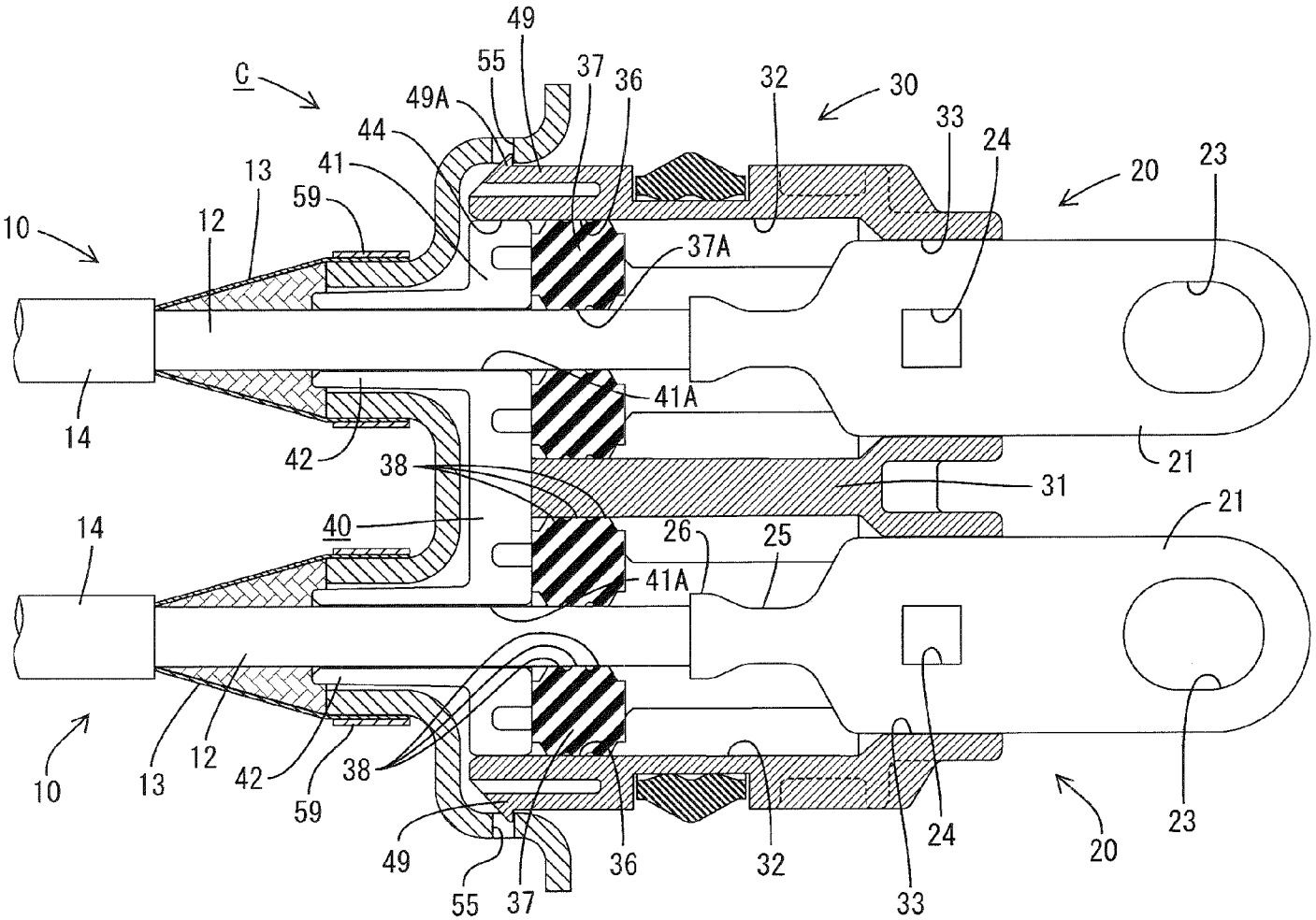
FIG. 5 is a plan sectional view of the shielding connector.

The terminal fitting 20 is made of a metal plate, for example, a copper alloy having a high conductivity and a bolt fastens the terminal fitting 20 to a terminal fitting of the mating appliance. As shown in FIG. 5, the terminal fitting 20 has a tongue-shaped main body 21 with an elliptic insertion hole 23 through which a bolt (see FIG. 6) can be inserted. A lance hole 24 is formed at a rear side of the main body 21. A wire barrel 25 and an insulation barrel 26 are formed rearward from the main body 21. The barrels 25 and 26 have a look-down posture. The terminal fitting 20 is fixed by caulking the wire barrel 25 to an end of a core wire 11 exposed to the outside by peeling the shielding electric wire 10 and caulking the insulation barrel 26 to an end of the inner insulation coating 12.

The housing 30 is formed in the shape of an elliptic tube in section. A partitioning wall 31 is formed inside the housing 30 at a central position thereof in a width direction thereof in a range from a front end of the housing to a position slightly forward from a rear end thereof. A terminal insertion chamber 32 is formed at left and right sides of the partitioning wall 31. A region having an area of about ⅔ of the rear side of the terminal insertion chamber 32 is formed sectionally circularly. A flat exit 33 is formed at an upper position of the front side of the terminal insertion chamber 32 into which the main body 21 of the terminal fitting 20 is inserted and projected. An elastically displaceable lance 35 is formed on a ceiling surface of the exit 33 and can be locked to the lance hole 24 formed through the terminal fitting 20.

A rubber stopper 37 is fit in an entrance 36 of each terminal insertion chamber 32. The rubber stopper 37 has a central hole 37A through which the end of the exposed insulation inner coating 12 of the shielding electric wire 10 can be inserted. Three lips 38 are formed on each of inner and outer peripheral surfaces of the rubber stopper 37.

A mounting concavity 44 is formed on a rear surface of the housing 30 for receiving a generally elliptical retainer 40 that is made of synthetic resin. Two protection tubes 42 project from a rear surface of a main body 41 of the retainer 40. The interval between the protection tubes 42 is equal to that of the shielding electric wires 10. An insertion hole 41A is formed through the main body 41 and communicates with a hollow portion of each protection tube 42. The end of the exposed insulation inner coating 12 of the shielding electric wire 10 is fit tightly into the protection tube 42 and the insertion hole 41A.

A locking convexity 43 is formed on upper and lower surfaces of the main body 41 of the retainer 40 at a central portion in a longitudinal direction of the retainer 40. A locking hole 45 is formed at corresponding positions of upper and lower surfaces of the mounting concavity 44 and receives the locking convexity 43. The elliptic retainer 40 is vertically divided into two parts at a position corresponding to the major axis thereof.

A fit-in groove 48 is formed at approximately the longitudinal center of the peripheral surface of the housing 30 and receives a sealing ring 47.

The rear surface of the housing 30 is covered with a shielding shell 50. The shielding shell 50 is formed as a thick metal plate, such as a zinc steel plate. The shielding shell 50 has an elliptic main body plate 51 slightly larger than the rear surface of the housing 30. A sectionally elliptic fit-in concavity 52 is formed concavely toward the rear end of the main body plate 51 and can receive a rear end portion of the housing 30. Left and right connection tubes 53 project rearward from a rear surface of the fit-in concavity 52. The interval between both connection tubes 53 is equal to that of the shielding electric wires 10. The protection tubes 42 of the retainer 40 can be inserted into the connection tubes 53.

The fit-in concavity 52 and the connection tube 53 formed on the main body plate 51 of the shielding shell 50 are formed by two-stage deep drawing.

Figure 1:
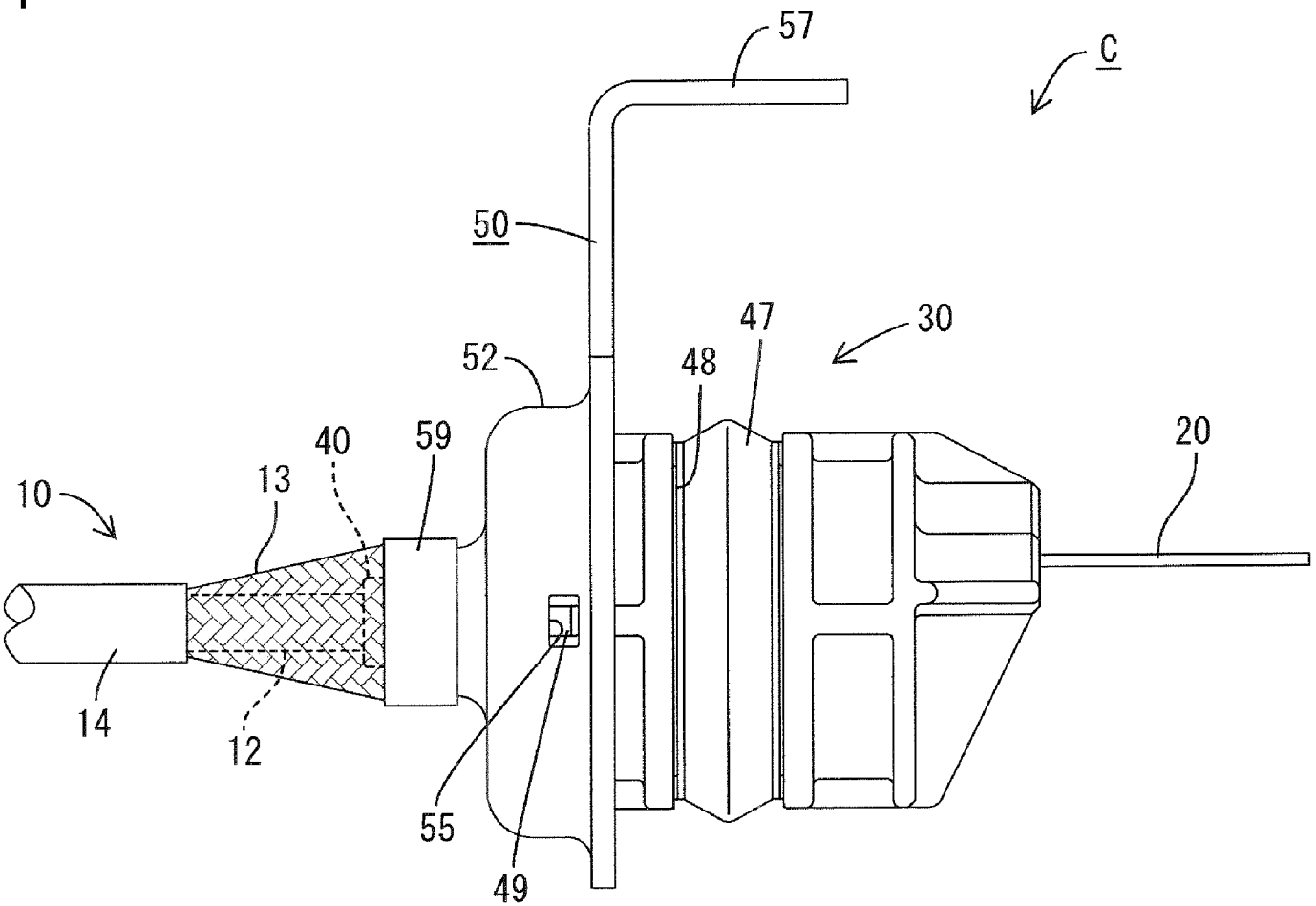
FIG. 1 is a side elevation of a shielding connector of one embodiment of the present invention.
Figure 2:
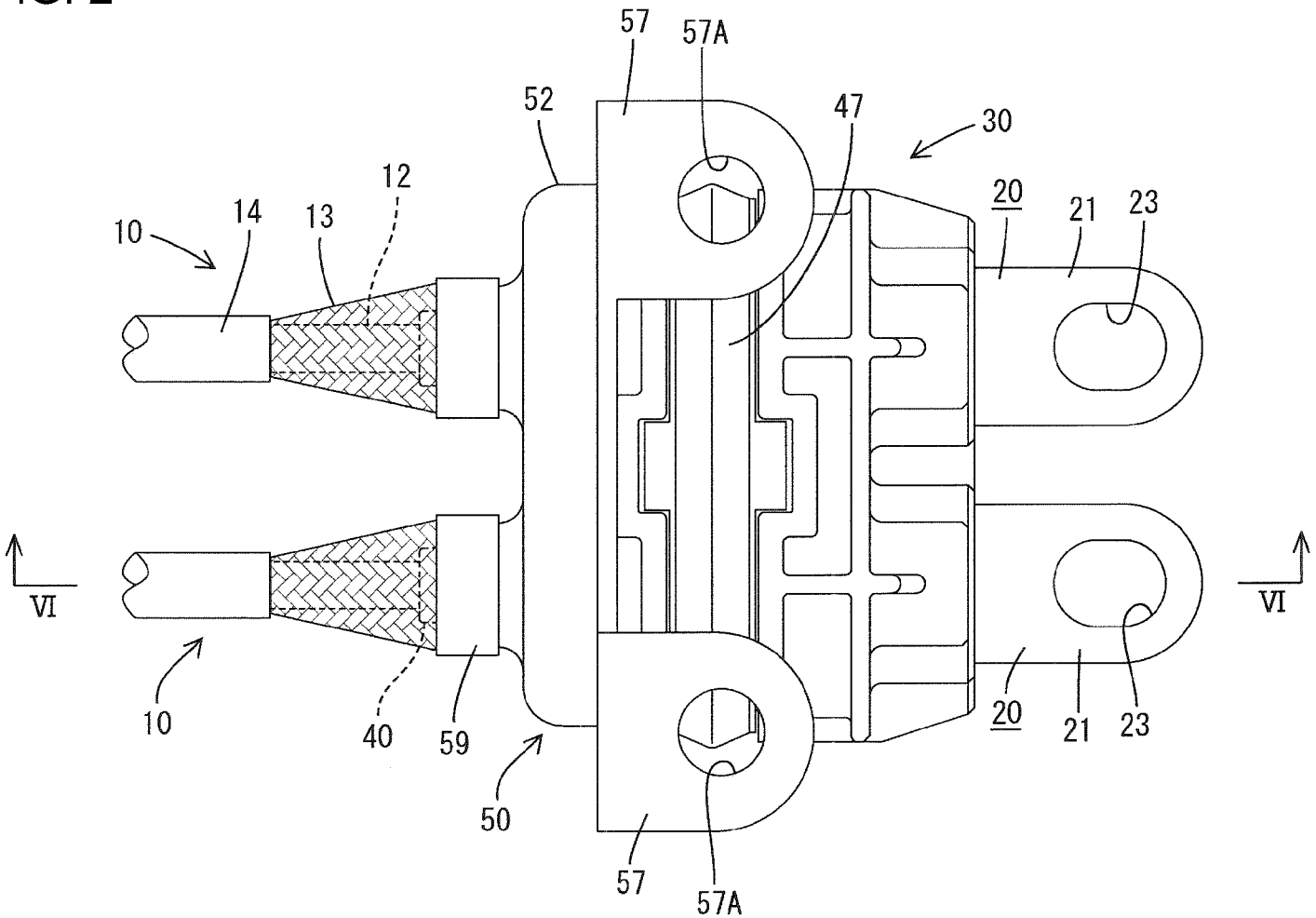
FIG. 2 is a plan view of the shielding connector.

As also shown in FIG. 1, a locking hole 55 is formed on left and right peripheral walls of the fit-in concavity 52 of the shielding shell 50 at a position near the front edge of the left and right peripheral walls and a center thereof in the vertical direction. A locking piece 49 is formed on left and right outer walls at a rear end portion of the housing 30. The locking piece 49 is extended rearward and cantilevered. A hooking portion 49A capable of fitting in the locking hole 55 is formed at an extended end, of the locking piece 49, which is elastically displaceable inward and outward.

Figure 3:
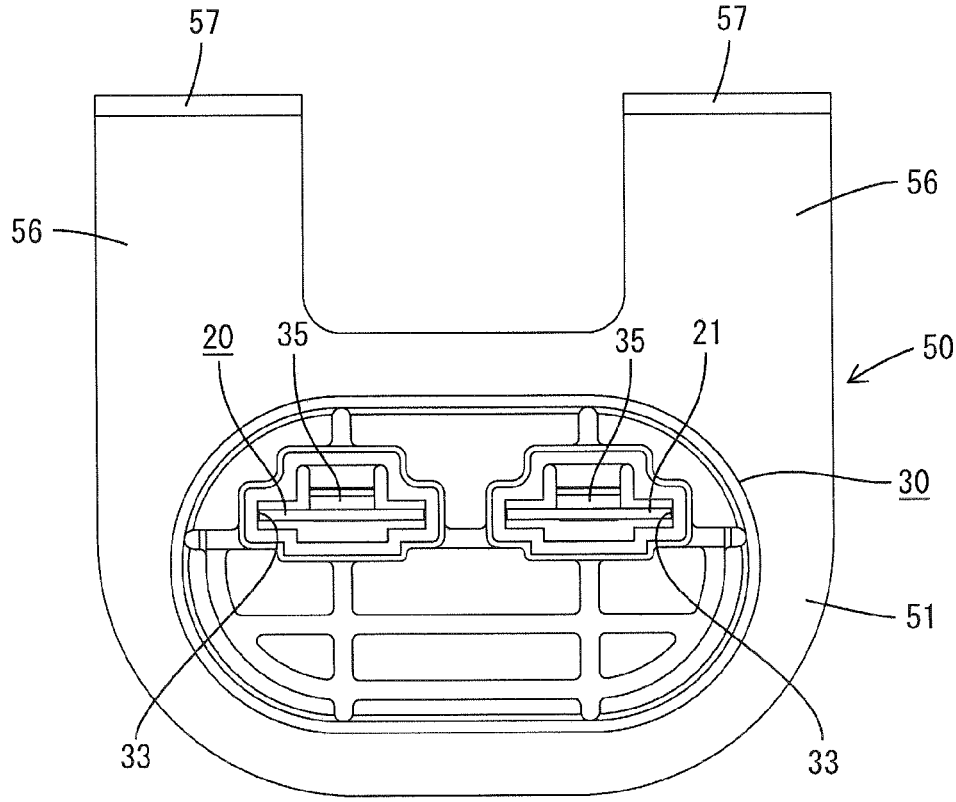
FIG. 3 is a front view of the shielding connector.
Figure 4:
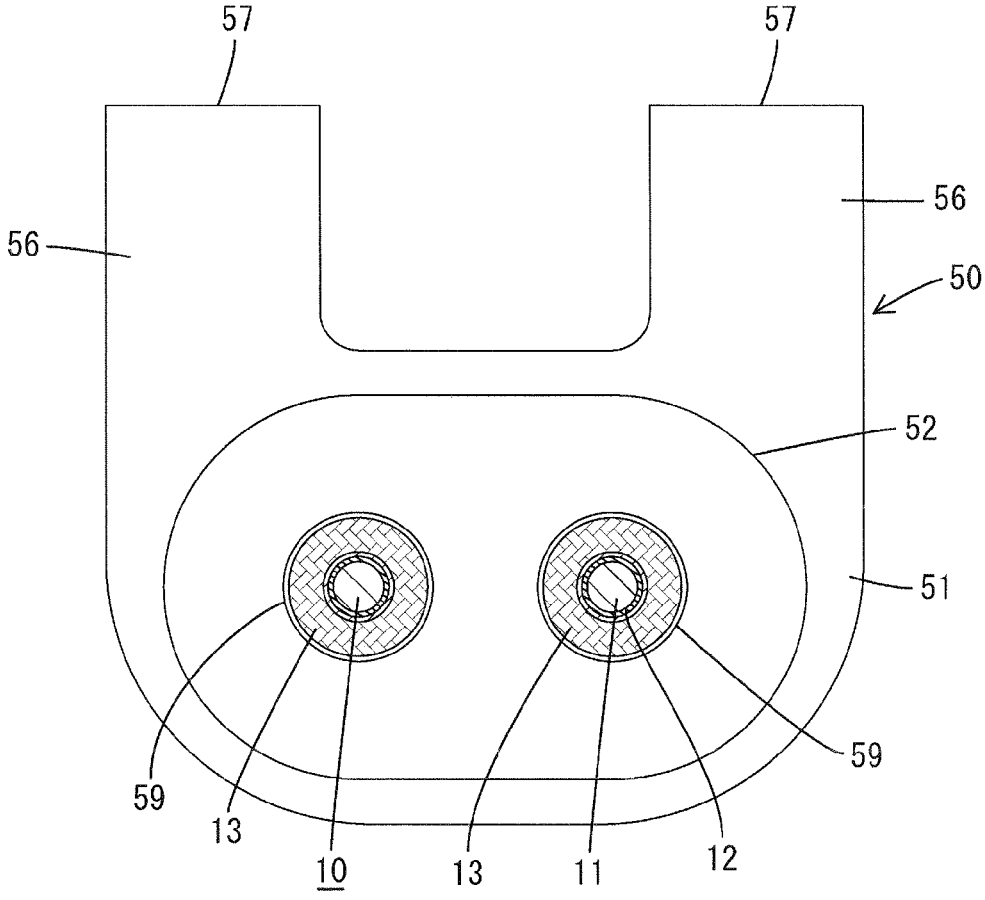
FIG. 4 is a rear view of the shielding connector.

As also shown in FIG. 3, an arm portion 56 is upwardly extended from left and right ends of an upper edge of the main body plate 51 of the shielding shell 50. An upper end of the arm portion 56 is bent forward and perpendicularly to form a mounting plate 57. A circular insertion hole 57A through which a bolt 58 (FIG. 6) is inserted is formed through both mounting plates 57.

As shown in FIG. 6, the case 60 of the inverter is formed in the shape of a box whose upper surface is open. The opening formed through the upper surface of the case 60 is closed with a cover plate (not shown in the drawings). A mounting hole 62 for mounting the connector C on the case 60 is formed through a side wall 61 of the case 60. A region of the housing 30 disposed at the longitudinal center thereof can be tightly fitted in the mounting hole 62.

Mounting seats 64 are formed on an upper surface of the side wall 61 of the case 60 with the mounting seats 64 disposed above the sealing ring 62. Both mounting plates 57 of the shielding shell 50 fixed to the housing 30 are placed on the mounting seats 64 respectively. A bolt hole (not shown in the drawings) is formed through each mounting seat 64.

A terminal base 65 is provided inside the case 60. A pair of terminals (not shown in the drawings) disposed at an appliance side is mounted on an upper surface of the terminal base 65. The main body 21 of the terminal fitting 20 projected from the housing 30 is placed on the appliance-side terminals mounted on the terminal base 65. The terminal fitting 20 can be fastened to the appliance-side terminals with the bolt 22.

An example of the procedure of assembling the connector C and an example of the procedure of mounting the inverter on the case 60 are described below.

The end of the insulation outer coating 14 of each shielding electric wire 10 is peeled in a predetermined length. The end of the exposed braided wire 13 is cut in a predetermined length. As a result, the insulation inner coating 12 is exposed forward in a predetermined length from the end of the braided wire 13. At this time, the exposed end of the braided wire 13 is pulled up and folded on the periphery of the end of the insulation outer coating 14. In this state, the end of each shielding electric wire 10 is inserted into the corresponding connection tube 53 of the shielding shell 50 from the rear side thereof. The shielding shell 50 is disposed rearward until the connection tube 53 is inserted into the end of the insulation outer coating 14. At this time, the end of each insulation inner coating 12 is inserted through the central hole 37A of the rubber stopper 37.

Thereafter the end of the insulation inner coating 12 of the shielding electric wire 10 is peeled to expose the end of the core wire 11. The barrels 25, 26 of the terminal fitting 20 are caulked to the end of the core wire 11 and that of the insulation inner coating 12 in above-described manner. Thereby the terminal fitting 20 is fixed with the terminal fitting 20 being electrically connected to the core wire 11.

In this state, each terminal fitting 20 fixed to the end of each shielding electric wire 10 is inserted into the corresponding terminal insertion chamber 32 of the housing 30 from the rear side thereof. Each terminal fitting 20 passes through the exit 33 and projects forward therefrom with the main body 21 thereof elastically displacing the lance 35. When the main body 21 projects in a predetermined mount, the lance 35 returns to its original state and is fitted in the lance hole 24. Thereby the terminal fitting 20 is prevented from being removed rearward.

After the housing 30 is fixed, the rubber stopper 37 is moved forward along the insulation inner coating 12 of each shielding electric wire 10 with both shielding electric wires 10 being pulled rearward. Thereafter the rubber stopper 37 is fitted on the entrance 36 of the corresponding terminal insertion chamber 32 of the housing 30.

Thereafter the split two parts of the retainer 40 are layered vertically one upon another at a position, of the insulation inner coating 12 of each shielding electric wire 10, which is projected rearward from the housing and integrated with each other with both insulation inner coatings 12 in penetration through the inner periphery of the protection tube 42 and the insertion hole 41A of the main body 41. In this manner, after the split two parts of the retainer 40 are integrated with each other, the lance 40 is moved forward along the insulation inner coating 12, and the main body 41 is fitted in the mounting concavity 44 disposed on the rear surface of the housing 30. As shown in FIG. 6, when the retainer 40 is pressed in a predetermined normal amount, the locking convexity 43 formed on the upper and lower surfaces of the main body 41 is fitted in the locking hole 45 formed on the upper and lower surfaces of the mounting concavity 44. Thereby the retainer 40 is fixed to prevent the rubber stopper 37 from being removed.

Thereafter the shielding shell 50 disposed rearward is moved forward along the shielding electric wire 10. Thereby the protection tube 42 of the retainer 40 fixed to the rear end of the housing 30 is inserted into the corresponding connection tube 53 of the shielding shell 50 from the front side thereof, and the rear end portion of the housing 30 is fitted in the fit-in concavity 52 of the shielding shell 50 from the front side thereof. When the rear end portion of the housing 30 is fitted in the mounting concavity 44 in the predetermined normal depth, as shown in FIG. 5, the hooking portion 49A of the locking piece 49 provided on the left and right peripheral surface of the rear end portion of the housing 30 is fitted in the locking hole 55 formed the left and right peripheral walls of the mounting concavity 44 and is elastically locked thereto. Thereby the shielding shell 50 is mounted on the rear surface of the housing 30. At this time, the protection tube 42 of the retainer 40 is inserted in the connection tube 53 of the shielding shell 50 throughout the entire length thereof.

Thereafter the end of each braided wire 13 pulled upward and rearward is returned forward and placed on the periphery of the connection tube 53. After the caulking ring 59 is fitted on the periphery of the braided wire 13, the caulking ring 59 is caulked and crimped thereto. Thereby the end of the braided wire 13 of each shielding electric wire 10 is fixed to the connection tube 53 of the shielding shell 50 with the end of the braided wire 13 electrically connected thereto. The caulking ring 59 can be simultaneously caulked to the braided wire 13 at two positions thereof with a common jig, because the mating connection tube 53 is projected at the rear surface of the shielding shell 50, i.e., projected outside the shielding shell 50.

When the connector C is assembled in the above-described manner, the housing 30 is inserted into the mounting hole 62 formed through the side wall 61 of the case 60 of the inverter. As shown in FIG. 6, when the main body plate 51 of the shielding shell 50 mounted on the rear surface of the housing 30 abuts the outer surface of the side wall 61 of the case 60, the pressing of the housing 30 is stopped. At this time, the main body 21 of each terminal fitting 20 projected from the front surface of the housing 30 is layered on the corresponding appliance-side terminal disposed on the upper surface of the terminal base 65 of the case 60. Thus by threading the bolt 22 inserted into the insertion hole 23 of the main body 21, the terminal fitting 20 is fixed to the terminal base 65 with the terminal fitting 20 being electrically connected to the corresponding appliance-side terminal.

At this time, both mounting plates 57 of the shielding shell 50 are placed on the mounting seat 64 of the case 60. Thus by screwing the bolt 58 inserted into the insertion hole 57A of the mounting plate 57 into the bolt hole of the mounting seat 64, the housing 30, namely, the connector C is fixed. Thereby the braided wires 13 of both shielding electric wires 10 are electrically connected to the case 60 through the shielding shell 50. At this time, the shielding shell 50, namely, the housing 30 is fixed to the side wall 61 of the case 60. The sealing ring 47 fitted on the peripheral surface of the housing 30 closely contacts the inner peripheral surface of the mounting hole 62 with the sealing ring elastically contracting. Thereby the mounting hole 62 can be securely sealed.

As described above, in the above-described embodiment, the inside of the housing 30 is waterproofed with the rubber stopper 37. The process of the embodiment of assembling the housing 30 is simpler than the case where the housing is formed from the molded resin. In addition the housing 30 can be sealed with a high reliability. In connecting the braided wire 13 of each shielding electric wire 10 to the shielding shell 50, the braided wire 13 is connected to the connection tube 53 projected at the outer-surface side of the shielding shell 50. Therefore it is possible to accomplish caulking and crimping simultaneously at two positions and thus perform the connection operation simply and reliably.

Because the fit-in concavity 52 and the connection tube 53 formed on the main body plate 51 of the shielding shell 50 are formed by two-stage deep drawing, the fit-in concavity 52 and the connection tube 53 can be easily formed.

The protection tube 42 made of synthetic resin is interposed between the insulation inner coating 12 of the shielded electric wire 10 and the connection tube 53 of the shielding shell 50 at the portion where the insulation inner coating 12 is inserted into the portion inside the connection tube 53. Therefore when he shielded electric wire 10 is shaken, the protection tube 42 prevents the insulation inner coating 12 from directly contacting the inner peripheral surface of the connection tube 53 made of metal. Thereby the insulation inner coating 12 is prevented from being damaged.

The present invention is not limited to the embodiments described above with reference to the drawings. For example, the following embodiments are included in the technical scope of the present invention.

The retainer having the protection tube of the shielding electric wire is not limited to the retainer composed of two split parts shown in the embodiment, but may be integrally formed.

In the above-described embodiment, as the rubber stopper, an individual-type rubber stopper to be fitted in each terminal insertion chamber has been exemplified. But it is possible to use a bulk-type rubber stopper for collectively sealing the entrance of each terminal insertion chamber.

The procedure of assembling the connector exemplified in the above-described embodiment is an example. It is possible to assemble the connector by taking other procedures. For example, the housing may be assembled after the braided wire is crimped to the connection tube of the shielding shell in advance.

It is possible to set the configuration of the shielding shell and particularly the configuration of the portion of the shielding shell to be fixed to the case as desired according to the construction of a case for a mating appliance.

The present invention is applicable to a shielding connector having not less than three poles.

What is claimed is:

1. A shielding connector comprising:

a plurality of shielding electric wires, each of the shielding electric wires having an insulation inner coating and a braided wire over the insulation inner coating;

terminal fittings mounted respectively on ends of said shielding electric wires;

a housing made of synthetic resin and configured for fitting in a mounting hole penetrating through a metal case of an appliance, a plurality of terminal insertion chambers provided inside said housing and receiving said terminal fittings respectively;

a rubber stopper fit on an entrance of each of said terminal insertion chambers; and a metal shielding shell mounted on said housing and having a concavity fit over and covering a rear surface of said housing, the metal shielding shell having a mounting portion to be fixed to said case, connection tubes projecting unitarily from a rear surface of said shielding shell and communicating respectively with said terminal insertion chambers, an end of the braided wire of each of said shielding electric wires being fitted on a periphery of said connection tube;

a caulking ring securing said end of said braided wire to said connection tube; and a protection member made of synthetic resin and fit in said connection tube, the protection member having a central hole into which the insulation inner coating of said shielding electric wire is inserted.

2. The shielding connector of claim 1, further comprising a retainer mounted to the housing and holding the rubber stopper at the entrance of the terminal insertion chamber.

3. The shielding connector of claim 2, wherein the protection member comprises a plurality of protection tubes projecting integrally from the retainer.

4. The shielding connector of claim 3, wherein the retainer has at least one locking convexity and the housing has at least one locking hole, the locking convexity being engaged in the locking hole to hold the retainer on the housing.

5. The shielding connector of claim 1, wherein the mounting portion of the shielding shell comprises arms projecting transverse to the wires and mounting plates projecting angularly from the arms for mounting to the case.

6. The shielding connector of claim 1, wherein the housing has at least one locking piece and the shielding shell has at least one locking hole locked to the locking piece for holding the shielding shell on the housing.

7. The shielding connector of claim 1, wherein the projection member has a plurality of protection tubes fit respectively in the connection tubes of the shielding shell.

* * * * *